United States Patent [19]

Johnson et al.

[11] 4,220,027

[45] Sep. 2, 1980

[54] METHOD FOR EXPLOSIVE FORMING OF TUBULAR MOLDS FOR CONTINUOUS STEEL CASTING

[75] Inventors: Lyle J. Johnson, Taylor, Mich.; Jimmy D. Mote, Littleton; Jack A. Yoblin, Boulder, both of Colo.

[73] Assignee: Concast, Inc., Montvale, N.J.

[21] Appl. No.: 594,861

[22] Filed: Jul. 10, 1975

Related U.S. Application Data

[63] Continuation-in-part of Ser. No. 492,419, Jul. 29, 1974, abandoned.

[51] Int. Cl.[2] ..... B21D 26/08

[52] U.S. Cl. ..... 72/56; 29/421 E

[58] Field of Search ..... 72/56, 54, 60, 61; 29/421 E

[56] References Cited

U.S. PATENT DOCUMENTS

| | | | |
|---|---|---|---|
| 3,090,113 | 5/1963 | Karpovich | 29/421 E |
| 3,153,848 | 10/1964 | Glyman et al. | 29/421 E |
| 3,172,199 | 3/1965 | Schmidt | 29/421 E |
| 3,186,203 | 6/1965 | Brady, Jr. et al. | 72/56 |
| 3,433,039 | 3/1969 | Henriksen | 72/56 |
| 3,927,546 | 12/1975 | Shrum | 72/56 |

*Primary Examiner*—Milton S. Mehr

[57] ABSTRACT

A method for explosively forming tubular copper molds of the type employed in continuous casting of steel billet and bloom sections.

22 Claims, 9 Drawing Figures

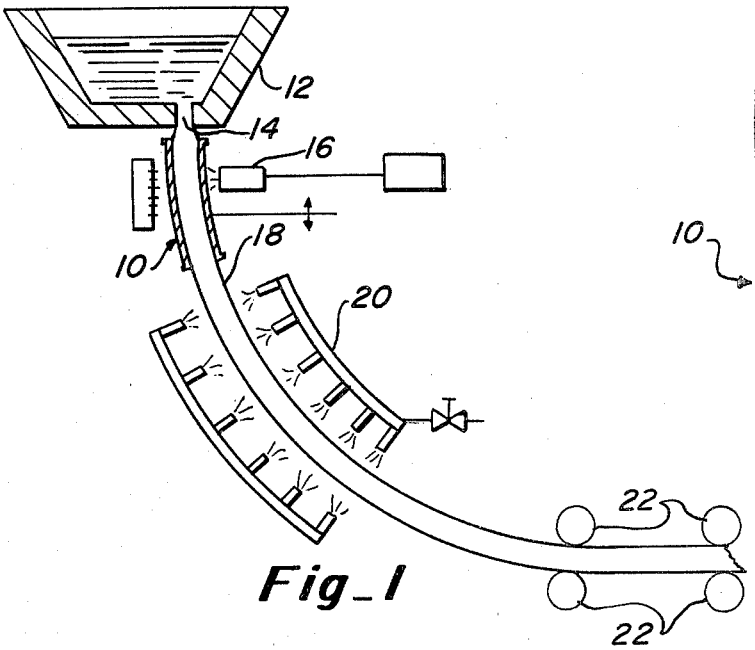
Fig_1
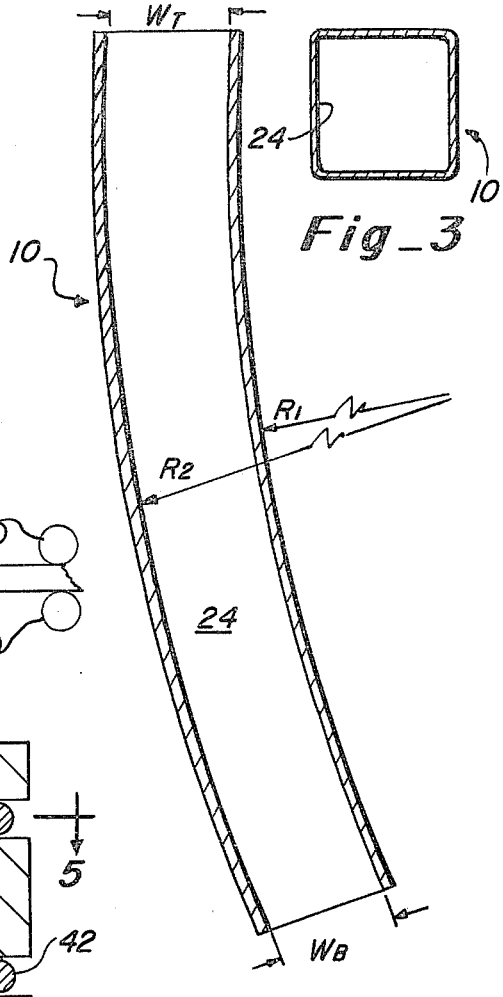
Fig_3
Fig_2
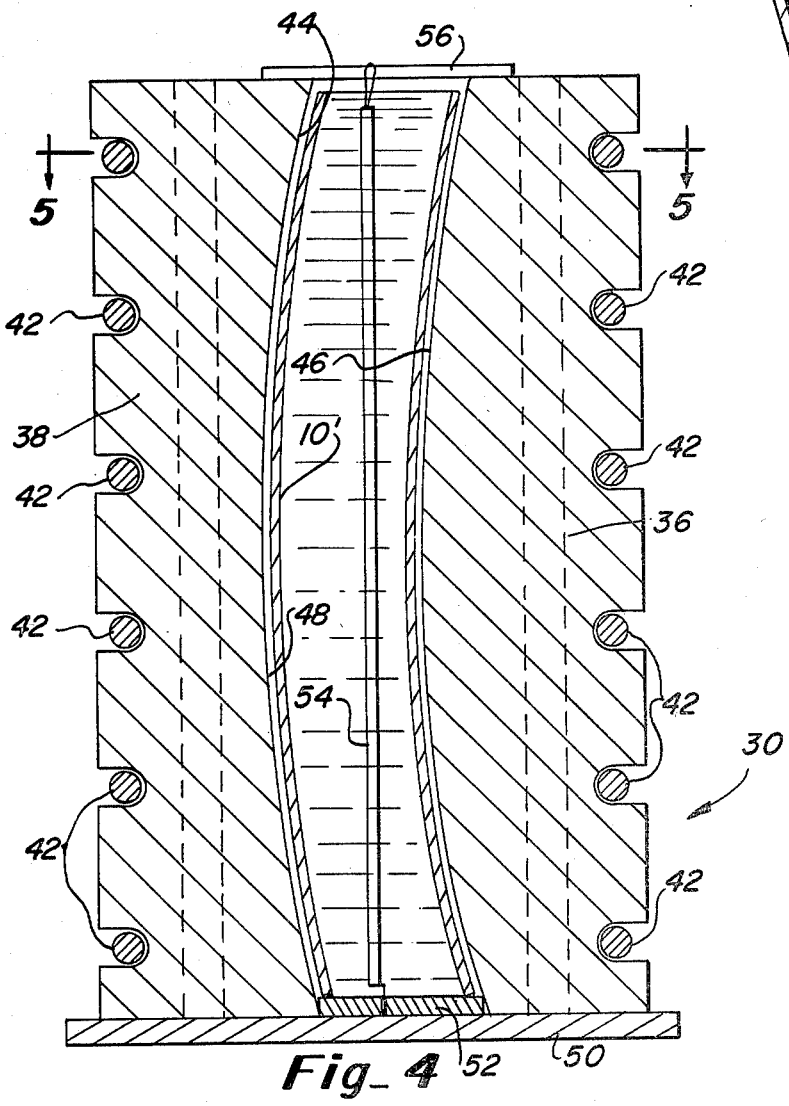
Fig_4

METHOD FOR EXPLOSIVE FORMING OF TUBULAR MOLDS FOR CONTINUOUS STEEL CASTING

This application is a continuation-in-part of U.S. Ser. No. 492,419 filed July 29, 1974, now abandoned.

BACKGROUND OF THE INVENTION

In the continuous casting of steel billets or bloom sections, tubular molds are normally employed where the billets to be formed are square, rectangular or round in cross section. In this process, generally the molten steel passes from the ladle into a tundish then through a tubular mold within which the steel is cooled during its passage so that it is discharged from the lower end of the mold as a continuous strand comprising a relatively thin outer solidified shell surrounding and enclosing a molten core. For optimum operation of the copper tube mold, the dimensions of the mold passage through which the steel passes are very critical and because of the configurations required in some instances are extremely difficult, if not impossible, to achieve within the desired tolerances by normally employed forming techniques.

The molten steel passing through such a copper tube mold is cooled during transit from a completely molten or liquid state at the upper or inlet end of the mold to an at least partially solidified state where an outer shell is formed at a distance above the discharge or lower end of the mold. In order to achieve rapid cooling without the adverse effects of shrinkage which causes separation of the steel shell from the inner walls of the copper mold, it is sometimes desired that the passage walls be convergently tapered toward the lower or discharge end thereby compensating for the shrinkage of the steel as it transits the passage through the copper mold. Further, because the molten steel is gravitationally poured into the mold in a vertical direction and subsequent handling elements convey the formed strand along a curved path which terminates in a horizontal path, it is frequently desirable that the mold passage be formed to a preselected radius of curvature. Typical dimensions for a copper mold of this type include a length of approximately 32 inches, three-eighths of an inch wall thickness with a passage of square (with round corners) transverse cross-section of 5.916 plus or minus 0.002 inches passage width at the top, 5.156 plus or minus 0.002 inches passage width at the bottom, 307 plus or minus one inches radius of curvature of the inner passage wall and 312 plus or minus one inches radius of curvature for the outside passage wall. Construction of a copper tube mold within the allowed tolerances presents an extremely difficult, if not impossible, task using presently known manufacturing techniques.

It is an object of the present invention to provide a manufacturing process for forming copper molds or mold members to extremely precise tolerances and with a very smooth inside surface finish having hardness value as measured on the inside surface which is higher than that of the original copper similarly measured.

SUMMARY OF THE INVENTION

In accordance with the present invention, molds for use in the continuous casting of steel billet or bloom sections are constructed from blanks of copper tubing having a transverse configuration in cross-section approximately matching that of the desired mold. Preferably, the blanks of copper tubing are subjected to a two-stage explosive forming process which reforms the tube blank to conform to the desired mold configuration and in particular to conform precisely to the desired configuration and dimensions of the mold passage.

In view of the fact that the invention is especially well adapted to the forming of molds having a curved mold passage as above described, it will be described hereinafter as applied to the manufacture of such molds, it being understood, however, that it may also be applied to advantage in the manufacture of molds having a straight mold passage. It may also be applied to advantage for the reconditioning of used molds having either curved or straight mold passages.

In the first stage of the forming process, a blank of virgin copper tubing, or a used copper mold which has had the inside surfaces cleaned, is placed in a female die cavity which is longitudinally curved to the approximate desired radii of curvature involved. In the case of virgin copper tubing, the blank may be pre-bent, if necessary, in order to facilitate its insertion within the female die cavity, but this may not be required where the radius of curvature is relatively large. An explosive charge in the form of a length of primacord is extended longitudinally through the tube within the female die and detonated. The tube may be filled with water prior to detonation of the explosive charge. The pressure created by detonating the explosive is directed against the inner walls of the tubular blank and reforms the tube to the curved configuration of the female die cavity. The deformed tube is then removed from the female die. A curved hardened steel mandrel or hob die (male die) whose external dimensions and surface finish are those of the desired final internal dimensions and surface finish of the curved copper mold passage to be formed in the mold is then inserted into the deformed metal tube. The tube is sealed at its upper and lower ends to the male die. Preferably, the male die is provided with internal passages which are connected to a vacuum source to evacuate the space between the interior of the copper tube and the exterior of the steel male die. An explosive charge is then disposed around and preferably in contact with the external walls of the deformed tube. This charge may take the form of either a sheet explosive (possibly over a buffer layer) covering the external walls of the tube, or may take the form of a length of primacord spirally wrapped directly around the external walls of the tube. To direct the pressure produced by the detonation of the explosive, the assembly is either immersed in water prior to detonation of the charge or enclosed within a container. Detonation of the charge compresses and reforms the walls of the tube so that the passage through the tube is precisely conformed to the configuration of the external surface of the male die.

It is important to seal the spaces between the copper tubing and the male die in order to prevent the gases or other debris generated by the detonated explosive from entering the said spaces at the ends of the copper tubing. For this purpose, sealing rings are located at the ends of the copper tubing. Preferably, the tube is confined between sealing abutments which engage the ends of the tube and seal the ends of the tube against the die. Preferably, sealing rings are located between the abutments and the ends of the tubing and are placed under compression to force their surfaces into tight sealing engagement with the ends of the tubing and with the adjacent walls of the die.

Usually, the die may be removed from the tubing without difficulty. If difficulty is experienced, the tubing may be heated externally to expand it sufficiently to permit easy withdrawal of the die.

A copper mold member so formed does not have undesirable surface irregularities that will impede the flow of metal therethrough or which create undesirable wear that adversely effect the flow of heat through said mold member.

The first stage of the forming process called preforming can, in some cases, be eliminated if the copper tube can otherwise be made to fit the male die used in the second or final forming stage.

Other objects and advantages of the invention will become apparent by reference to the following specification and to the drawings.

BRIEF DESCRIPTION OF THE DRAWINGS

FIG. 1 is a schematic side elevational view of a typical steel continuous casting arrangement employing a copper tube mold of the type with which the present invention is concerned;

FIG. 2 is a longitudinal cross-sectional view of a copper tube mold;

FIG. 3 is a transverse cross-sectional view of a copper tube mold;

FIG. 4 is a cross-sectional view taken on a vertical plane showing one step in the formation of a copper tube mold in accordance with the present invention.

BRIEF DESCRIPTION OF THE PREFERRED EMBODIMENTS

Figure 5:
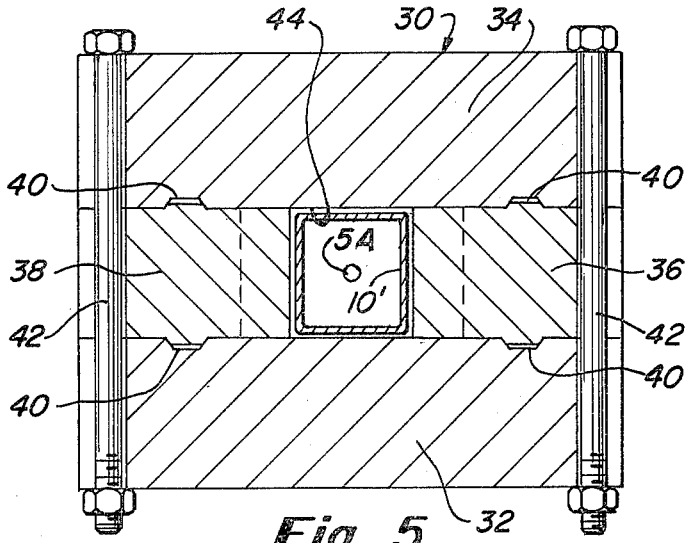
FIG. 5 is a cross-sectional view taken on line 5—5 of FIG. 4.

Referring first to FIGS 1–3, in FIG. 1 there is shown a schematic diagram of a continuous casting system employing, by way of example, a curved copper tube mold 10 shown in cross-sectional views of FIGS. 2 and 3. The system of FIG. 1 has a tundish 12 containing a supply of molten steel which is discharged through an opening 14 into the internal passage of mold 10. Flow of steel from the tundish 12 to mold 10 is controlled by automatically operating metering means (not shown). At the exterior of mold 10, a controlled water cooling system (normally a water box surrounding mold 10) schematically illustrated at 16 is employed to cool the mold during passage of steel through the mold 10 so that a continuous strand of steel 18 having a solidified external shell is continuously discharged from the lower end of copper tube mold 10. The strand 18 is then passed through further cooling devices schematically illustrated at 20 and then passed through feed rolls as at 22 for cutting to length plus further working.

Referring now to FIGS. 2 and 3, copper tube mold 10 is formed as a hollow tubular member of substantially square cross-section (with rounded corners) as shown in FIG. 3, the usual material of mold 10 being copper or a copper alloy. As best seen in FIG. 2, the hollow tubular mold is formed with a curvature to assist in deflecting the moving continuous billet of steel from a vertical plane to a horizontal plane and is also tapered convergently from top to bottom to compensate for the progressive solidification shrinkage of the steel as it is cooled during its passage through mold 10. This prolongs contact of the cooling steel billet with the water cooled copper tube mold and maximum heat transfer through the walls of the mold member and thereby promoting rapid shell growth. Typical dimensions for a mold 10 employed in the formation of a continuous billet of steel nominally five inches square in cross-section are as follows:

R1=307″±1″
R2=312″±1″
Wt=5.196″±0.002″
Wb=5.156″±0.002″ the overall length of finished mold 10 being approximately 32 inches.

A mold of the foregoing dimensions is formed from a blank taking the form of an approximate 36 inch length of square cross-section copper tubing (for example, an extrusion) having an initial passage width of approximately 5 5/32 inches and a wall thickness of 0.3 inches.

In the first stage of the forming process, the tubing blank from which the mold member 10 is formed is placed within a female die 30 having a longitudinally curved die cavity whose radii of curvature approximately correspond to the desired final curvatures of mold member passage 24 (307 inches for R1 and 312 inches for R2).

As best seen in FIG. 5, the female die 30 is made up of a pair of side plates 32 and 34 and a pair of end plates 36 and 38 located relative to each other as by tongue and groove members 40 and laterally clamped in positions by a plurality of nut and bolt members indicated generally by numeral 42. The inner surfaces of end plates 36 and 38 are curved to the above-mentioned radii of curvature and when assembled with side plates 32 and 34 cooperatively define a die cavity 44 of a uniform square transverse cross-section, the cavity being longitudinally curved as best seen in FIG. 4 with curved surface 46 of end plate 36 having a radius of curvature of 307 inches plus or minus 9 inches and the curved surface 48 of end plate 38 being curved to a radius of 312 inches plus or minus 9 inches radius. In the usual case, it is preferable that the copper tube blank be mechanically bent or deformed to approximately the correct curvature before insertion into female die 30. The external width of the unformed tube 10′ (FIG. 5) is 5.75 inches while the square cavity 44 in this instance is 5.800 inches square which is sufficient over the approximate 36 inch length of the cavity to create an interference fit if the tube blank 10′ is not bent to some extent prior to insertion.

The assembled female die and tube blank 10′ are placed upon a plate 50 with the lower end of the tube blank 10′ resting upon a resilient sealing element 52 which forms a water tight seal at the lower end of tube 10′ and also serves as a lower locating or anchor member for a length of explosive primacord 54 which is extended longitudinally up through the interior of tube 10′ and fastened at its upper end to a locating and supporting bar 56. Preferably, the interior of tube 10′ is filled with water prior to the detonation of the explosive charge 54.

Upon detonation of the charge 54, the explosive force generated is directed against the inner walls of the tube and uniformly expands tube 10' outwardly into contact with the inner walls of die cavity 44 thus to deform tube 10' into a tube 10'' having a close approximation of the desired final curvature of the completed mold 10. The tube 10'' is still of a uniform square transverse cross-section, however, the expansive force of the detonation of primacord 54 slightly increases the internal dimensions of the tube passage to approximately 5.200 inches.

The curved tube 10'' is then removed from die 30 and a hardened steel mandrel (hob) or male die 60 (FIG. 6) is then inserted into the interior of the deformed tube 10''. Alternatively, the die 60 may be inserted into a used mold which is to be reconditioned.

The external dimensions of male die 60 are precisely those of the internal dimensions of the yet to be completed mold 10 in that the curvature of the front and rear faces 62 and 64 of die 60 are 307 and 312 inch radii, respectively, to within the desired final tolerance of plus or minus one inch. Further, the side walls of die 60 are tapered from a width of 5.197" plus or minus 0.002 inches at the top 66 of the die to 5.155" plus or minus 0.002 inches at the bottom 68 of die 60.

Figure 6:
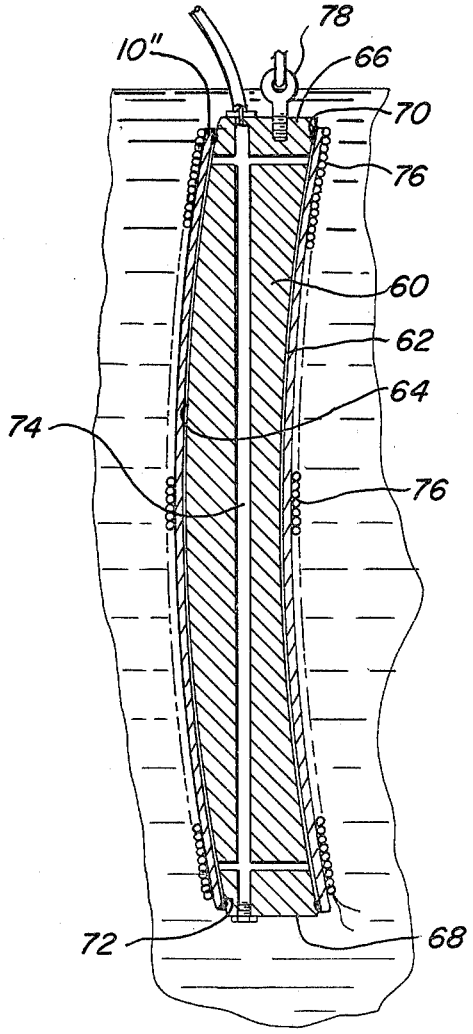
FIG. 6 is a cross-sectional view taken on a central vertical plane showing a subsequent step in the formation of the copper tube mold.
Figure 9:
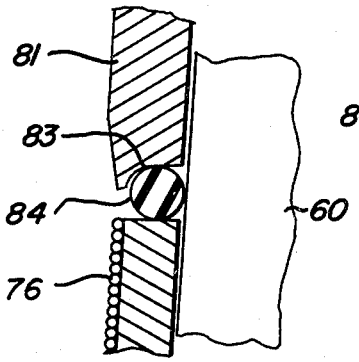
FIG. 9 is an enlarged cross-sectional detail of FIG. 8.
Figure 8:
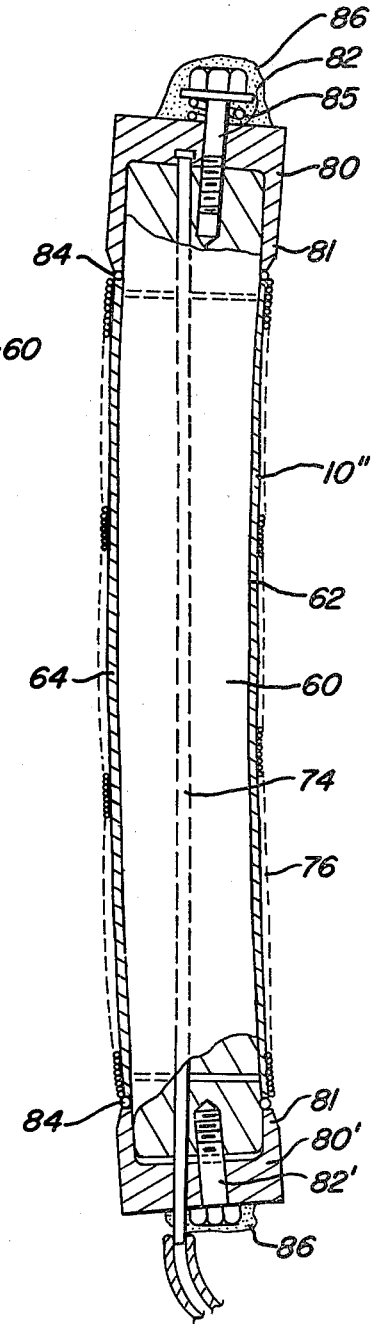
FIG. 8 is a cross-sectional view similar to FIG. 6, but showing the preferred method of sealing the tubular blank to the die.

After the male die 60 has been inserted into the tube 10'', the tube is sealed to the die 60 at its top and bottom as at 70, 72 of FIG. 6. Preferably, however, the tube is confined between sealing abutments which in the embodiment illustrated in FIGS. 8 and 9, are in the form of end caps 80 and 80' which are mounted on the ends of the die with their depending flanges 81 opposed to the respective ends of the tube. The end caps are secured to the die by bolts 82 and 82', one or both of which are adjustable and spring loaded for reasons hereinafter explained. The ends of the depending flanges are each provided with an annular groove 83 adapted to receive an O-ring 84 of suitable sealing material which engages the end surface of the tube and the wall of the die to seal tightly the joint between the tube and the die to prevent the gases and other debris generated by the detonated explosive from entering the space between the tube and the die. After assembly of the parts as shown in FIGS. 8 and 9 with the O-ring engaging the end surfaces of the tube, the O-rings are subjected to compressive forces by tightening one or both of the bolts 82 and 82'. In the preferred embodiment illustrated, only the bolt 82 is tightened, which said bolt is spring loaded by interposing the spring 85 between the cap and the bolt head. The tightening of the bolt deforms the material of the O-rings to force their surfaces into tight sealing engagement with the ends of the tube and with the adjacent walls of the die. The space around the bolts 82, 82' may, if desired, by sealed by applying sealing compound 86 thereto.

Air within the space between the interior of tube 10'' and die 60 and the end caps and die is evacuated via internal passages such as 74 bored through the interior of die 60. A substantially uniform layer of plastic sheet or cord explosive is placed around the exterior, or an explosive such as primacord 76, can be spirally wrapped all over the external surfaces of tube 10'' to achieve the desired results. In some cases, the edges or other areas may be reinforced with additional explosive to achieve higher forces in these areas. The assembly is then immersed within a body of water, being suspended in any convenient manner, and the explosive is detonated to deform explosively copper tube 10'' to form its internal passage precisely to the external configurations of the curved and tapered hob die 60.

In some cases, a buffer material such as styrofoam, rubber, paper, cork, air, etc., may be used to separate the explosive from direct contact with tube 10''. This may be done to protect the outer surface of the copper tube mold 10'' and/or to establish a standoff between the explosive charge and the copper mold 10''. Alternatively, the assembled die and tube 10'' may be placed in a suitable container with a powder explosive surrounding the outer side of tube 10''.

Figure 7:
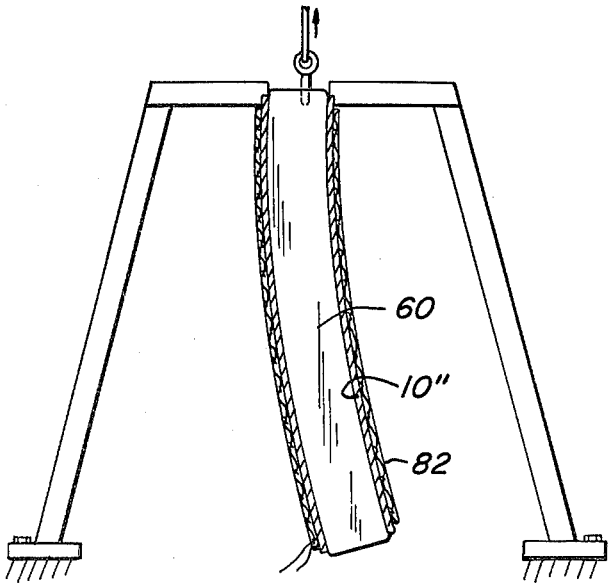
FIG. 7 is a side elevational view partially in cross-section, showing the step of removing the male or hob die from the completed copper tube mold.

If necessary in order to remove male die 60 from the interior of the finally formed mold 10'', heat can be applied to mold 10'', such as by wrapping mold 10'' with an electric blanket 82 (FIG. 7), and the mold is heated until it is expanded to a point sufficient to enable the withdrawal of die 60 from the mold interior.

In the case of virgin copper tubing which exceeds the desired final length, the tube 10'' is then accurately cut to its desired final length which for the specific mold described is approximately 32 inches plus or minus 0.010 inches long. It will be understood that the tube 10'' is cut to final length by removing from one or both ends of the tube 10'' a longitudinally extending portion to form mold members 10 and in a manner such that the top and bottom width dimensions are 5.196" plus or minus 0.002 and 5.156 plus or minus 0.002, respectively. One of the important uses of this invention, however, is to explosively form or recondition a worn copper mold of the desired length. In this case, no trimming of length dimensions is required and all other overall tolerances can be restored by the process.

A copper mold formed from the aforedescribed process has an improved interior finish as compared to conventionally extruded copper molds. The internal surface finish of the copper mold after imploding it on the male tool approximates the surface finish of the hardened steel tool itself. Typically, the smoothness of the inner surface is better than RMS 32, and the hardness of the unalloyed, high purity copper tube mold is in the range of Rockwell B 50 to 75. The hardness of an as-extruded copper tube mold would normally be in the range of Rockwell B 32.5 to 40. The Rockwell B or Brinnel system for measuring hardness of materials is conventionally used in the trade. Further, a reconditioned copper mold formed with the process of the present invention will have scratches and other wear marks removed, even where the wear marks were the cause for retiring the mold in the first place.

Another feature of the present invention is that special geometries such as concavities, convexities, etc., can be incorporated into the copper mold by machining these onto the surface of the steel mandrel or male tool 60. Such special surface geometries are useful for increasing the surface area and hence enabling heat to be removed more rapidly, and can improve the rate at which molten metal is continuously cast through the mold. Also, a texture can be imprinted on the outside of the mold 10' with the female die most of which will remain after imploding on the male die. This texture can be useful in breaking up laminar water flow, which would increase the heat removal efficiency of the cooling water around the copper tube mold while it is in service.

The invention has been described in detail with particular reference to preferred embodiments thereof, but it will be understood that variations and modifications can be effected within the spirit and scope of the invention.

We claim:

1. A method of forming an elongate hollow tubular mold member having a longitudinally extending passage therethrough, said method comprising the steps of:

inserting a hollow tubular blank into the cavity of a female die, said cavity having a configuration approximating that of the external walls of the mold member to be formed;

subjecting the inner walls of said blank to a deforming force by directing the pressure provided from detonating an explosive against said inner walls to deform the outer walls of said blank to the configuration of said cavity of said female die;

removing the deformed blank from said female die;

inserting a male die into the interior of said deformed blank, said male die having an external configuration corresponding to the desired internal configuration of the longitudinally extending passage of the mold member to be formed;

subjecting said outer walls of said blank to a deforming force by directing the pressure produced from detonating another explosive against said outer walls to deform said inner walls of said blank into a configuration wherein the passage of said blank conforms to the external configuration of said male die; and removing said male die from said deformed blank, the step of removing said male die from said deformed blank including expanding said deformed blank by applying heat energy thereto.

2. A method of forming an elongate hollow tubular mold member having a longitudinally extending passage therethrough, said method comprising the steps of:

inserting a hollow tubular blank into the cavity of a female die, said cavity having a configuration approximating that of the external walls of the mold member to be formed;

subjecting the inner walls of said blank to a deforming force by directing the pressure provided from detonating an explosive against said inner walls to deform the outer walls of said blank to the configuration of said cavity of said female die, the step of subjecting said inner walls to a deforming force including extending a length of primacord longitudinally through the passage of said blank, filling the remainder of said passage of said blank with water, and then detonating said length of primacord;

removing the deformed blank from said female die;

inserting a male die into the interior of said deformed blank, said male die having an external configuration corresponding to the desired internal configuration of the longitudinally extending passage of the mold member to be formed;

subjecting said outer walls of said blank to a deforming force by directing the pressure produced from detonating another explosive against said outer walls to deform said inner walls of said blank into a configuration wherein said passage of said blank conforms to the external configuration of said male die; and removing said male die from said deformed blank.

3. A method of forming an elongate hollow tubular mold member provided with a longitudinally extending passage which has a longitudinal center line with a predetermined radius of curvature, said method comprising the steps of:

bending a hollow tubular blank to a rough approximation of the curvature of the longitudinally extending passage of the mold member to be formed;

inserting the bent blank into the cavity of a female die, said cavity having a configuration approximating that of the external walls of the mold member to be formed;

subjecting the inner walls of said blank to a deforming force by directing the pressure provided from detonating an explosive against said inner walls to deform the outer walls of said blank to the configuration of said cavity of said female die;

removing the deformed blank from said female die;

inserting a male die into the interior of said deformed blank, said male die having an external configuration corresponding to the desired internal configuration of the longitudinally extending passage of the mold member to be formed;

subjecting said outer walls of said blank to a deforming force by directing the pressure produced from detonating another explosive against said outer walls to deform said inner walls of said blank into a configuration wherein the passage of said blank conforms to the external configuration of said male die; and removing said male die from said deformed blank.

4. A method of forming an elongate hollow tubular mold member having a longitudinally extending passage therethrough, said method comprising the steps of:

inserting a hollow tubular blank into the cavity of a female die, said cavity having a configuration approximating that of the external walls of the mold member to be formed;

subjecting the inner walls of said blank to a deforming force by directing the pressure provided from detonating an explosive against said inner walls to deform the outer walls of said blank to the configuration of said cavity of said female die;

removing the deformed blank from said female die;

inserting a male die into the interior of said deformed blank, said male die having an external configuration corresponding to the desired internal configuration of the longitudinally extending passage of the mold member to be formed, and said male die being provided with a fluid passage extending lengthwise of said male die and a transverse passage communicating therewith and extending through the side walls of said male die;

subjecting said outer walls of said blank to a deforming force by directing the pressure produced from detonating another explosive against said outer walls to deform said inner walls of said blank into a configuration wherein the passage of said blank conforms to the external configuration of said male die; and removing said male die from said deformed blank.

5. A method of forming an elongate hollow tubular mold member having a longitudinally extending passage therethrough, said method comprising the steps of:

inserting a male die into the interior of a tubular blank, said die having an external configuration corresponding to the desired internal configuration of the longitudinally extending passage of the mold member to be formed;

confining said tubular blank between sealing abutments engaging the end surfaces of said blank which seal the space between said blank and said die;

subjecting the outer walls of said blank to a deforming force by directing the pressure produced by detonating an explosive against said outer walls to deform the inner walls of said blank into a configuration wherein the passage of said blank conforms to the external configuration of said die; and removing said die from the deformed blank, the step of removing said die from said deformed blank including expanding said deformed blank by applying heat energy thereto.

6. A method as defined in claim 5 which includes the step of evacuating the sealed space between said blank and said die prior to subjecting said blank to said deforming force.

7. A method as defined in claim 5 which includes the step of immersing said blank and said die into a body of water prior to subjecting said blank to said deforming force.

8. A method of forming an elongate hollow tubular mold member having a longitudinally extending passage therethrough, said method comprising the steps of:

inserting a male die into the interior of a tubular blank, said die having an external configuration corresponding to the desired internal configuration of the longitudinally extending passage of the mold member to be formed;

confining said blank between sealing abutments engaging the end surfaces of said blank which seal the space between said blank and said die, at least one of said abutments being spring-loaded; and subjecting the outer walls of said blank to a deforming force by directing the pressure produced by detonating an explosive against said outer walls to deform the inner walls of said blank into a configuration wherein the passage of said blank conforms to the external configuration of said die.

9. A method of forming an elongate hollow tubular mold member having a longitudinally extending passage therethrough, said method comprising the steps of:

inserting a male die into the interior of a tubular blank, said die having an external configuration corresponding to the desired internal configuration of the longitudinally extending passage of the mold member to be formed;

confining said blank between sealing abutments engaging the end surfaces of said blank which seal the space between said blank and said die, said sealing abutments including O-rings of sealing material, and said O-rings being subjected to compressive forces to deform them to force their surfaces into tight sealing engagement with said end surfaces of said blank and the adjacent walls of said die; and subjecting the outer walls of said blank to a deforming force by directing the pressure produced by detonating an explosive against said outer walls to deform the inner walls of said blank into a configuration wherein the passage of said blank conforms to the external configuration of said die.

10. A method as defined in claim 9 which includes the step of evacuating the sealed space between said blank and said die prior to subjecting said outer walls of said blank to said deforming force.

11. A method of forming an elongate hollow tubular mold member having a longitudinally extending passage therethrough wherein the inner walls of said passage are convergent toward one end of said passage and the longitudinal center line of said passage has a predetermined radius of curvature, said method comprising the steps of:

inserting a hollow tubular blank into the cavity of a female die, said blank having a longitudinal dimension greater than the corresponding longitudinal dimension of the mold member to be formed and said cavity having a configuration approximating that of the external walls of the mold member to be formed;

subjecting the inner walls of said passage to a deforming force by directing the pressure provided from detonating an explosive against the inner walls of the passage of said blank to deform the outer walls of said blank to the configuration of the cavity of the female die;

removing said deformed blank from said female die;

inserting a male die into the interior of the deformed blank, said male die having an external configuration corresponding to the desired internal configuration of the longitudinally extending passage of the mold member to be formed;

subjecting the external walls of said blank to a deforming force by directing the pressure produced from detonating another explosive against the external walls of said deformed blank to deform the inner walls of the passage of said blank into a configuration wherein the longitudinally extending passage of the blank conforms to the external configuration of said male die;

removing said male die from said deformed blank; and removing from at least one end of said blank a longitudinally extending portion to form a mold member of a predetermined longitudinal dimension.

12. A method as defined in claim 11 including the step of bending the hollow tubular blank to a rough approximation of the desired final curvature prior to the step of inserting the blank into the female die.

13. A method as defined in claim 12 wherein the step of removing the male die from the deformed blank further comprises the step of expanding said blank by applying heat energy thereto.

14. A method as defined in claim 11 wherein the step of removing the male die from the deformed blank further comprises the step of expanding said blank by applying heat energy thereto.

15. A method as defined in claim 11 wherein the last name step includes removing from each end of said blank a longitudinally extending portion to form a mold member of a predetermined longitudinal dimension.

16. A method of forming an elongate hollow tubular mold member having a longitudinally extending passage therethrough wherein the walls of said passage are convergent toward one end of said passage and the longitudinal center line of said passage has a predetermined radius of curvature, said method comprising the steps of:

inserting a hollow tubular blank into the cavity of a female die, said blank having overall dimensions equal to or greater than the corresponding dimensions of the mold member to be formed and said cavity having a configuration approximating that of the curved configuration of the mold member to be formed;

subjecting the inner walls of said passage to a deforming force by directing the pressure produced from detonating an explosive against the inner walls of the passage of said blank to deform said blank to the approximate final curvature of the mold member to be formed;

removing said deformed blank from said female die;

inserting a male die into the interior of the deformed blank, said male die having an external configuration corresponding to the desired internal configuration of the longitudinally extending passage of the mold member to be formed; and subjecting the external walls of said blank to a deforming force by directing the pressure produced from detonating another explosive against the external walls of said deformed blank to deform the inner walls of the passage of said blank to a configuration wherein the inner walls of the passage of said blank conform to the external configuration of said male die.

17. A method of forming an elongate hollow tubular mold member having a longitudinally extending passage therethrough wherein the walls of said passage are convergent toward one end of said passage and the longitudinal center line of said passage has a predetermined radius of curvature, said method comprising the steps of:

inserting a hollow tubular blank into the cavity of a female die, said blank having overall dimensions equal to or greater than the corresponding dimensions of the mold member to be formed and said cavity having a configuration approximating that of the curved configuration of the mold member to be formed;

subjecting the inner walls of said passage to a deforming force by directing the pressure produced from detonating an explosive against the inner walls of the passage of said blank to deform said blank to the approximate final curvature of the mold member to be formed;

removing said deformed blank from said female die;

inserting a male die into the interior of the deformed blank, said male die having external walls corresponding to the desired internal configuration of the longitudinally extending passage of the mold member to be formed, said male die having a fluid passage formed therein and communicating with the external walls of said male die and also with one end of said male die; and subjecting the external walls of said blank to a deforming force by directing the pressure produced from detonating another explosive against the external walls of said deformed blank to deform the inner walls of the passage of said blank to a configuration wherein the inner walls of the passage of said blank conform to the external walls of said male die.

18. A method as defined in claim 17 wherein the step of inserting the blank into the female die cavity further comprises the step of bending the blank to a rough approximation of the desired final curvature prior to the step of inserting the blank into the female die.

19. A method as defined in claim 17 wherein the step of inserting a male die into said blank further comprises the step of sealing the opposite ends of said blank to said male die and evacuating the sealed spaced between the interior walls of the blank and the exterior walls of the male die prior to subjecting the external walls of the blank to said deforming force.

20. A method as defined in claim 19 further comprising the step of immersing the sealed blank and male die into a body of water prior to subjecting the external walls of said blank to a deforming force.

21. A method as defined in claim 19 further comprising the step of applying heat energy to the deformed blank subsequent to the step of subjecting the external walls of said blank to a deforming force to facilitate removal of the male die from the deformed blank.

22. A method as defined in claim 17 wherein the step of subjecting the inner walls of the passage of said blank to a deforming force includes extending a length of primacord longitudinally through the passage of said blank, filling the remaining passage of said blank with water, and detonating the length of primacord.

* * * * *